US010566741B2

(12) United States Patent
Maesoba et al.

(10) Patent No.: US 10,566,741 B2
(45) Date of Patent: Feb. 18, 2020

(54) SHIELDED CONNECTOR

(71) Applicants: AutoNetworks Technologies, Ltd., Yokkaichi-shi, Mie (JP); Sumitomo Wiring Systems, Ltd., Yokkaichi-shi, Mie (JP); SUMITOMO ELECTRIC INDUSTRIES, LTD., Osaka-shi, Osaka (JP)

(72) Inventors: Hiroyoshi Maesoba, Yokkaichi (JP); Kazuhiro Yoshida, Yokkaichi (JP); Toshifumi Ichio, Yokkaichi (JP); Masanao Yamashita, Osaka (JP)

(73) Assignees: AutoNetworks Technologies, Ltd., Yokkaichi-shi, Mie (JP); Sumitomo Wiring Systems, Ltd., Yokkaichi-shi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 16/314,382

(22) PCT Filed: Jun. 19, 2017

(86) PCT No.: PCT/JP2017/022510
§ 371 (c)(1),
(2) Date: Dec. 28, 2018

(87) PCT Pub. No.: WO2018/003567
PCT Pub. Date: Jan. 4, 2018

(65) Prior Publication Data

US 2019/0207347 A1 Jul. 4, 2019

(30) Foreign Application Priority Data

Jul. 1, 2016 (JP) ..... 2016-131438

(51) Int. Cl.
*H01R 13/648* (2006.01)
*H01R 13/6581* (2011.01)
(Continued)

(52) U.S. Cl.
CPC ..... *H01R 13/6581* (2013.01); *H01R 13/41* (2013.01); *H01R 13/6594* (2013.01)

(58) Field of Classification Search
CPC ..... H01R 13/6594
(Continued)

(56) References Cited

U.S. PATENT DOCUMENTS 5,266,038 A * 11/1993 Nakamura ..... H01R 13/432 439/607.06
5,281,169 A * 1/1994 Kiat ..... H01R 12/712 439/607.35
(Continued)

FOREIGN PATENT DOCUMENTS

JP 11-67365 3/1999
JP 11-74029 3/1999
(Continued)

OTHER PUBLICATIONS

International Search Report dated Aug. 29, 2017.
Japanese Office Action dated Oct. 15, 2019.

*Primary Examiner* — Neil Abrams
(74) *Attorney, Agent, or Firm* — Gerald E. Hespos; Michael J. Porco; Matthew T. Hespos

(57) ABSTRACT

A shielded connector includes a dielectric module (20) having an L-shaped terminal fitting (24) attached to a dielectric (21) and an outer conductor (30) that houses the dielectric module (20). The outer conductor (30) has a housing (31) with a first opening (35) at a front, a second opening (36) at a rear of a lower surface, and an insertion port (37) at a rear end communicating with the second
(Continued)

opening (36). A lid (43) is continuous with an edge of the insertion port (37) and is displaced from an open position where the insertion port (37) is opened to allow insertion of the dielectric module (20) into the module housing (31) to a closed position where the insertion port (37) is closed. With the lid (43) closed, an outer plate (47) on the lid (43) covers the holding portion (41) on the module housing (31) to prevent accidental release.

4 Claims, 13 Drawing Sheets

(51) Int. Cl.
*H01R 13/41* (2006.01)
*H01R 13/6594* (2011.01)

(58) Field of Classification Search
USPC ..... 439/607.4, 607.35
See application file for complete search history.

(56) References Cited

U.S. PATENT DOCUMENTS 5,637,015 A * 6/1997 Tan ..... H01R 13/658 439/607.37
6,007,381 A 12/1999 Ando et al.
6,165,015 A * 12/2000 Wu ..... H01R 23/6873 439/607.01
6,203,336 B1 * 3/2001 Nakamura ..... H01R 13/64 439/607.42
6,220,895 B1 4/2001 Lin
7,645,165 B2 * 1/2010 Wu ..... H01R 13/6582 439/607.38
7,727,019 B2 * 6/2010 Droesbeke ..... H01R 13/6594 439/607.35
8,206,177 B2 * 6/2012 Chang ..... H01R 13/502 439/607.35
9,263,833 B2 * 2/2016 Cheng ..... H01R 12/724
2019/0207347 A1 * 7/2019 Maesoba ..... H01R 13/41

FOREIGN PATENT DOCUMENTS

JP 2002-270306 9/2002
JP 2005-209423 8/2005
JP 2008-192474 8/2008
JP 2012-69353 4/2012
JP 2012-182099 9/2012
JP 2015-225781 12/2015

* cited by examiner

SHIELDED CONNECTOR

BACKGROUND

Field of the Invention

The present invention relates to a shielded connector.

Related Art

Japanese Unexamined Patent Application Publication No. 2008-192474 discloses a shielded connector including a dielectric module having an L-shaped terminal fitting attached to a dielectric and an outer conductor which houses the dielectric module. The outer conductor is constructed by assembling an outer conductor body and a lid body. The outer conductor body has a box shape whose front end surface, rear end surface, and a lower surface rear end portion are opened, and the opening of the rear end surface and the opening of the lower surface rear end portion communicate with each other. The dielectric module is inserted into the outer conductor body through the opening of the rear end surface. After the dielectric module is inserted into the outer conductor body, the opening of a rear end surface of a dielectric body is closed with the lid body, whereby assembly of the outer conductor is completed.

In the shielded connector described above, since the outer conductor is constituted of two components, namely, the outer conductor body and the lid body, there is a problem that the manufacturing cost, the management cost and the like will be increased.

The present invention has been completed based on the above situation and aims to reduce the number of components.

SUMMARY

The present invention is directed to a shielded connector including:

a dielectric module having an L-shaped terminal fitting attached to a dielectric; and an outer conductor that houses the dielectric module.

In this shielded connector, the outer conductor is a single component including:

a box-shaped module housing portion having a front end surface opened as a first opening, a rear end side region of a lower surface opened as a second opening, and a rear end surface opened as an insertion port communicating with the second opening; and a plate-shaped lid portion that is continuous with an opening edge of the insertion port and is displaceable from an open position where the insertion port is opened to allow the dielectric module to be inserted into the module housing portion to a closed position where the insertion port is closed; and an outer plate portion that is continuous with the lid portion and overlaps an outer surface of the module housing portion in a state in which the lid portion has been displaced to the closed position.

In this shielded connector, a region of the module housing portion where the outer plate portion overlaps is provided with a holding portion to which the dielectric is locked whereby the dielectric module is held in the module housing portion, and in a state in which the lid portion has been displaced to the closed position, the holding portion is covered and hidden by the outer plate portion from an outer surface side.

In a state in which the lid portion is at the open position, the dielectric module can be inserted into the module housing portion through the insertion port. After the dielectric module is inserted into the module housing portion, the insertion port is closed by displacing the lid portion from the open position to the closed position. Since the outer conductor is a single component in which the module housing portion and the lid portion are integrated, the number of components can be reduced. Furthermore, a shielding function is improved in a region of the module housing portion where the outer plate portion overlaps. Still furthermore, the holding portion can prevent the dielectric from being separated due to interference of foreign matter, so that the dielectric module can be reliably housed in the module housing portion.

DETAILED DESCRIPTION

The present invention may include an outer plate portion that is continuous with the lid portion and overlaps an outer surface of the module housing portion in a state in which the lid portion has been displaced to the closed position. According to this configuration, a shielding function is improved in a region of the module housing portion where the outer plate portion overlaps.

In the present invention, the region of the module housing portion where the outer plate portion overlaps is provided with a holding portion to which the dielectric is locked whereby the dielectric module is held in the module housing portion. According to this configuration, the holding portion can prevent the dielectric from being separated due to interference of foreign matter, so that the dielectric module can be reliably housed in the module housing portion.

The present invention may include a protrusion formed on the outer surface of the module housing portion and a window hole that is formed in the outer plate portion and causes the protrusion to be exposed therethrough only when the lid portion is at the closed position. According to this configuration, it is possible to detect whether or not the lid portion has been displaced to the closed position based on whether or not the protrusion is exposed through the window hole.

In the present invention, both ends of a boundary line dividing the module housing portion and the lid portion may be formed with a pair of cutout portions. According to this configuration, the boundary line can serve as a hinge easy to bend due to the paired cutout portions, so that processing accuracy is improved when the lid portion is displaced from the open position to the closed position.

Embodiment 1

Figure 1:
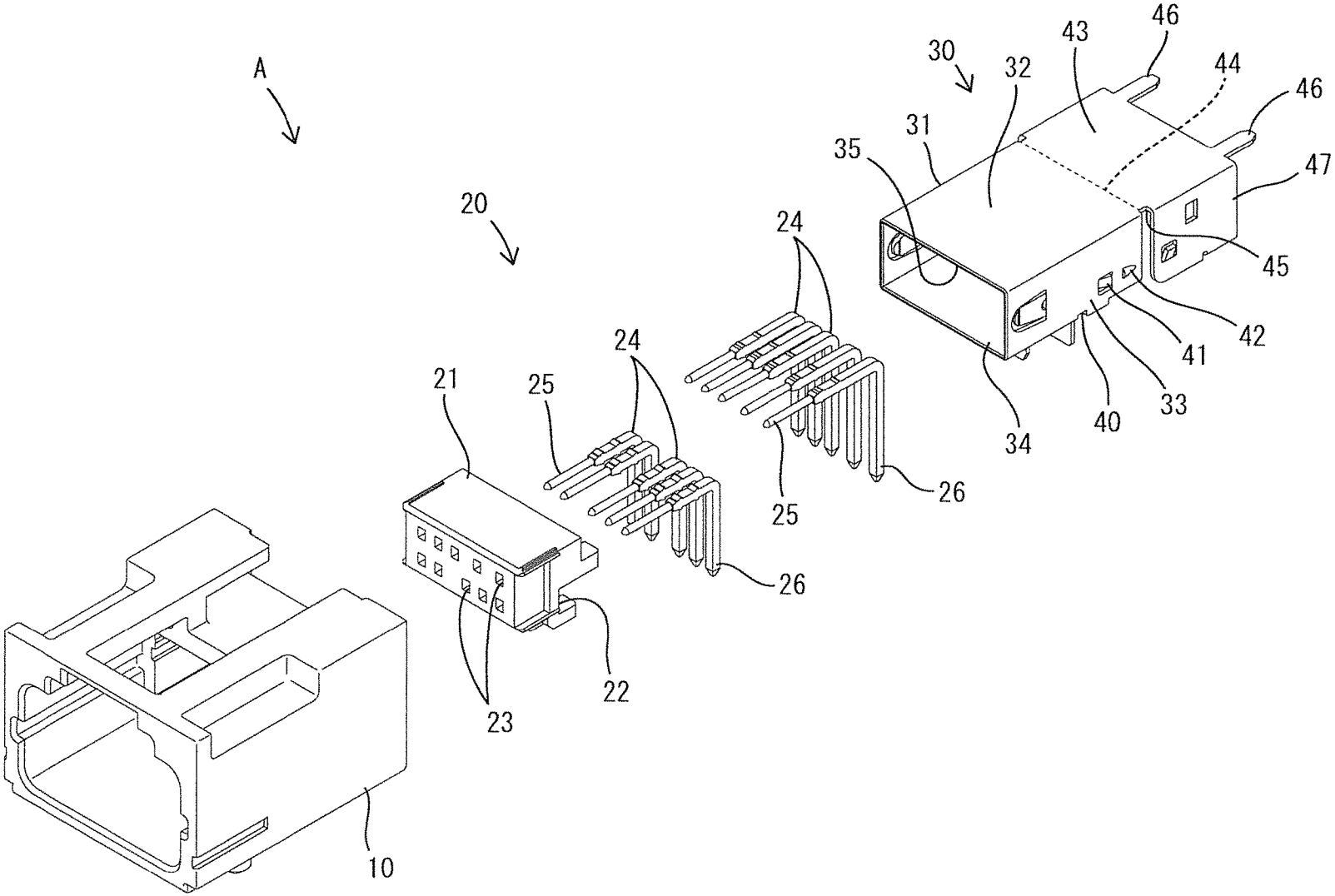
FIG. 1 is an exploded perspective view of a shielded connector of Embodiment 1.
Figure 2:
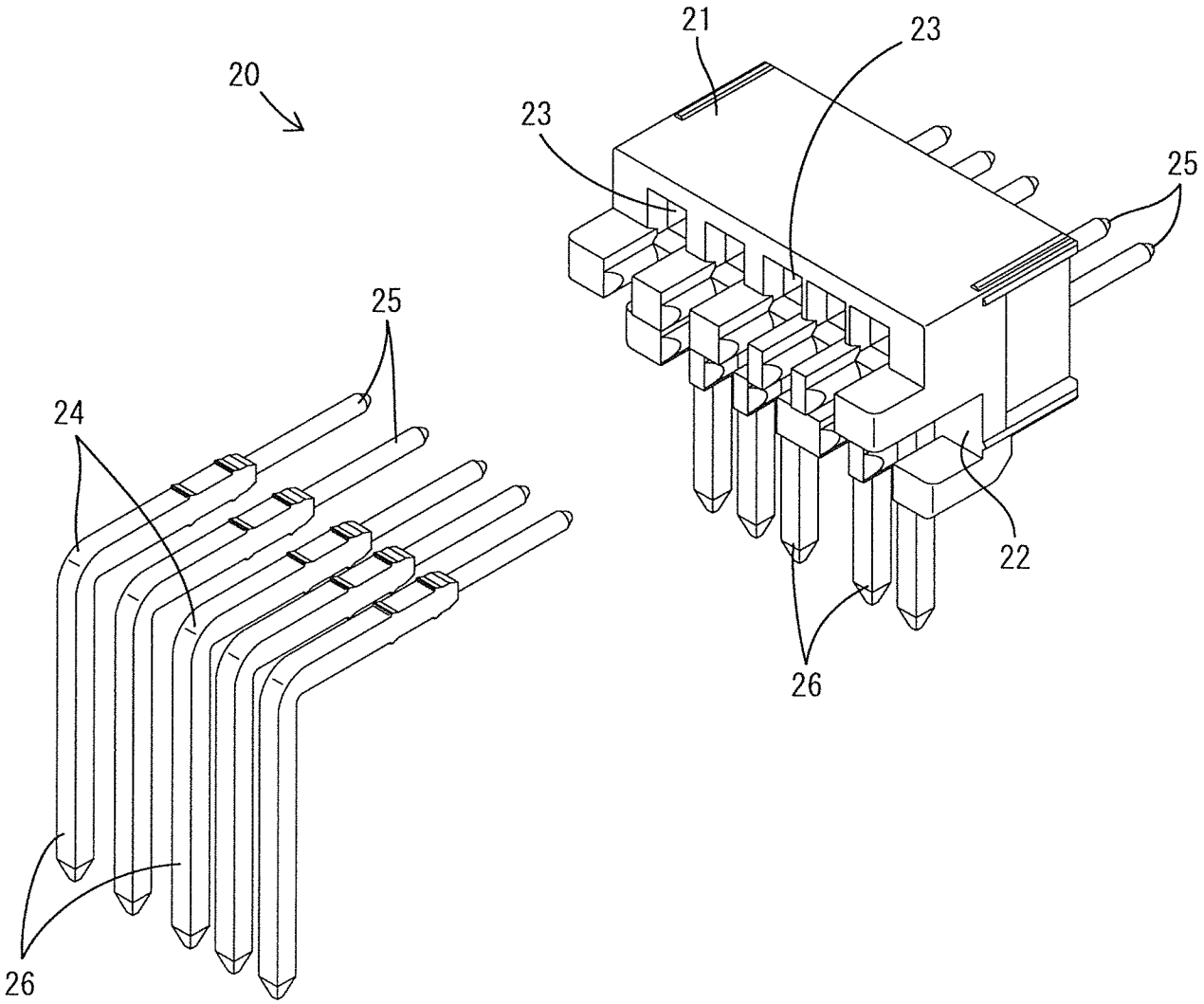
FIG. 2 is a perspective view showing a state in which a dielectric and a terminal fitting are separated.
Figure 3:
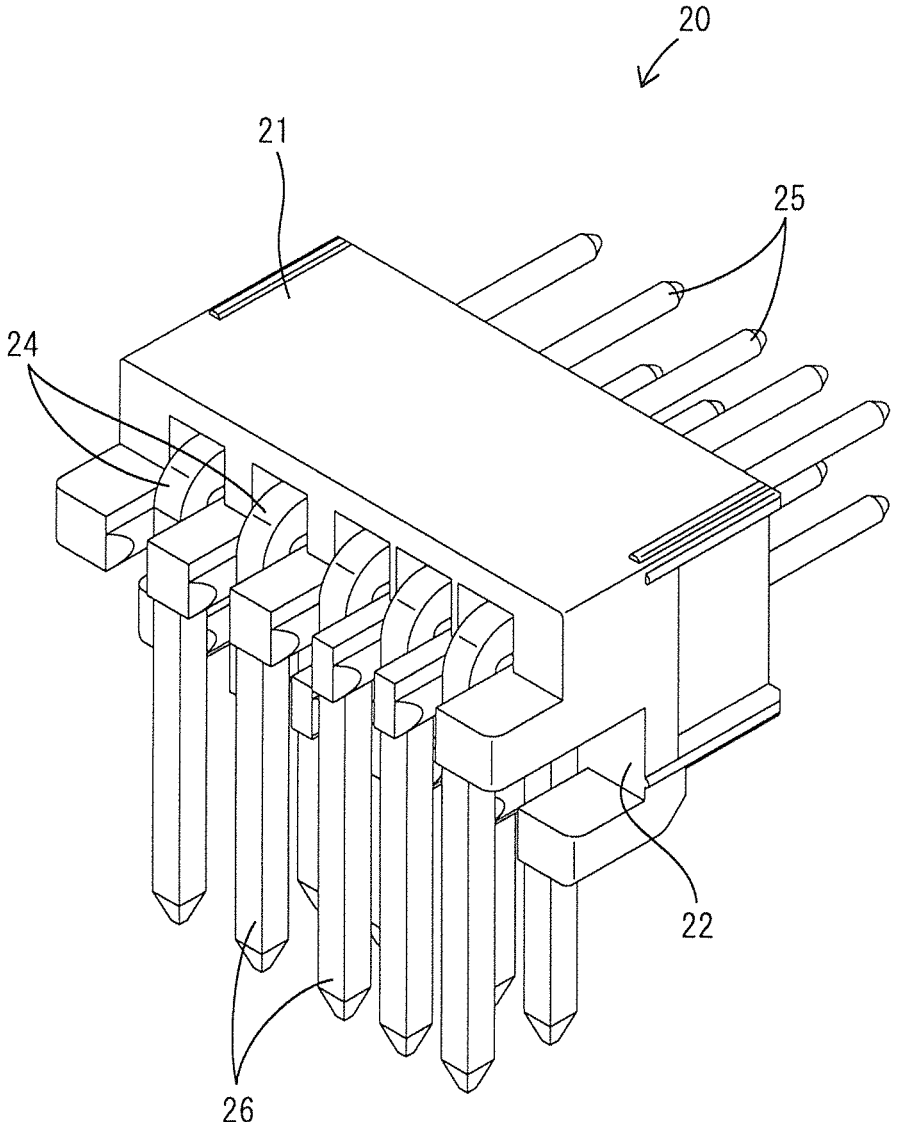
FIG. 3 is a perspective view of a dielectric module.
Figure 4:
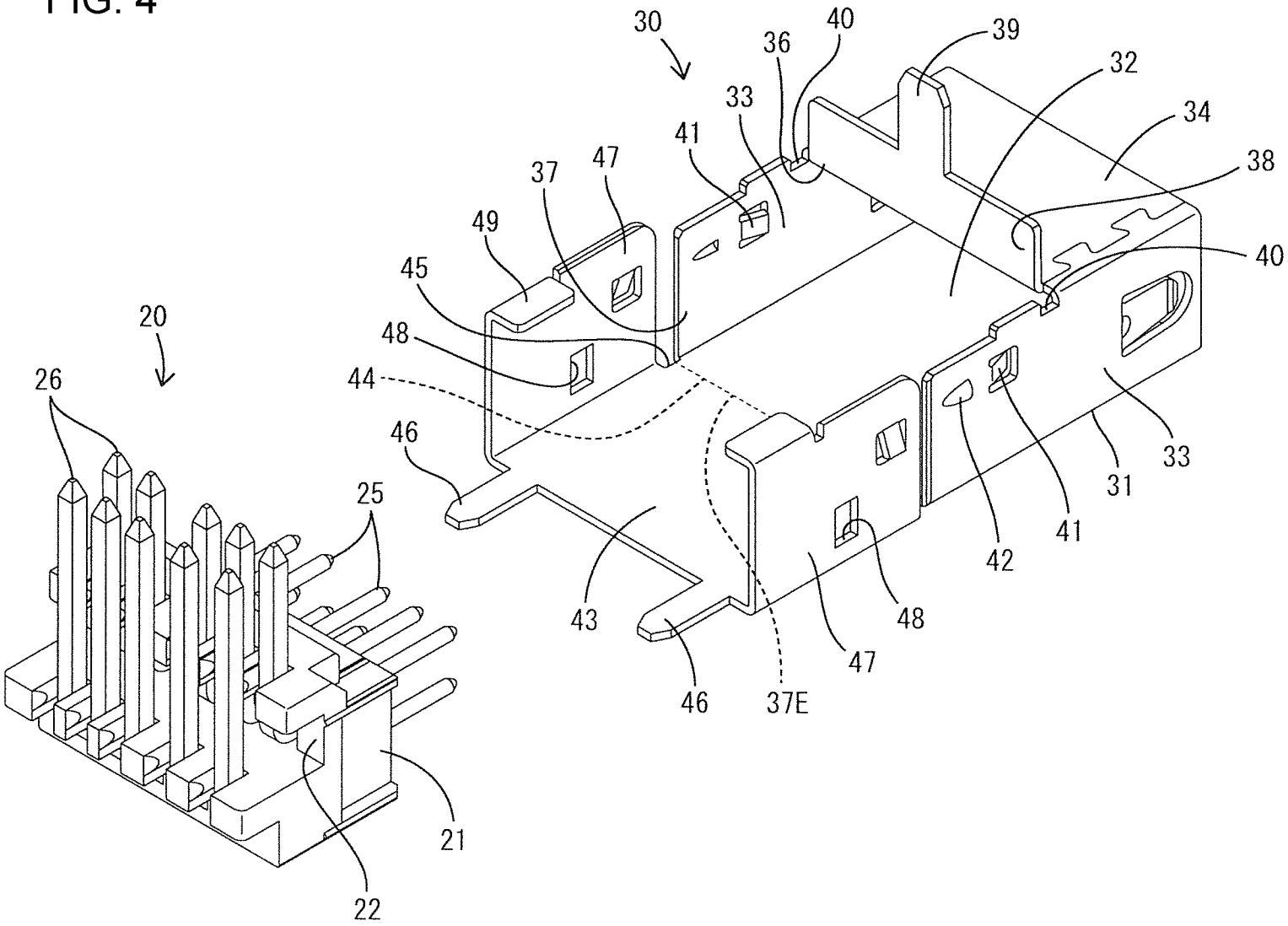
FIG. 4 is a vertically inverted perspective view showing a state in which an outer conductor and the dielectric module are separated.
Figure 5:
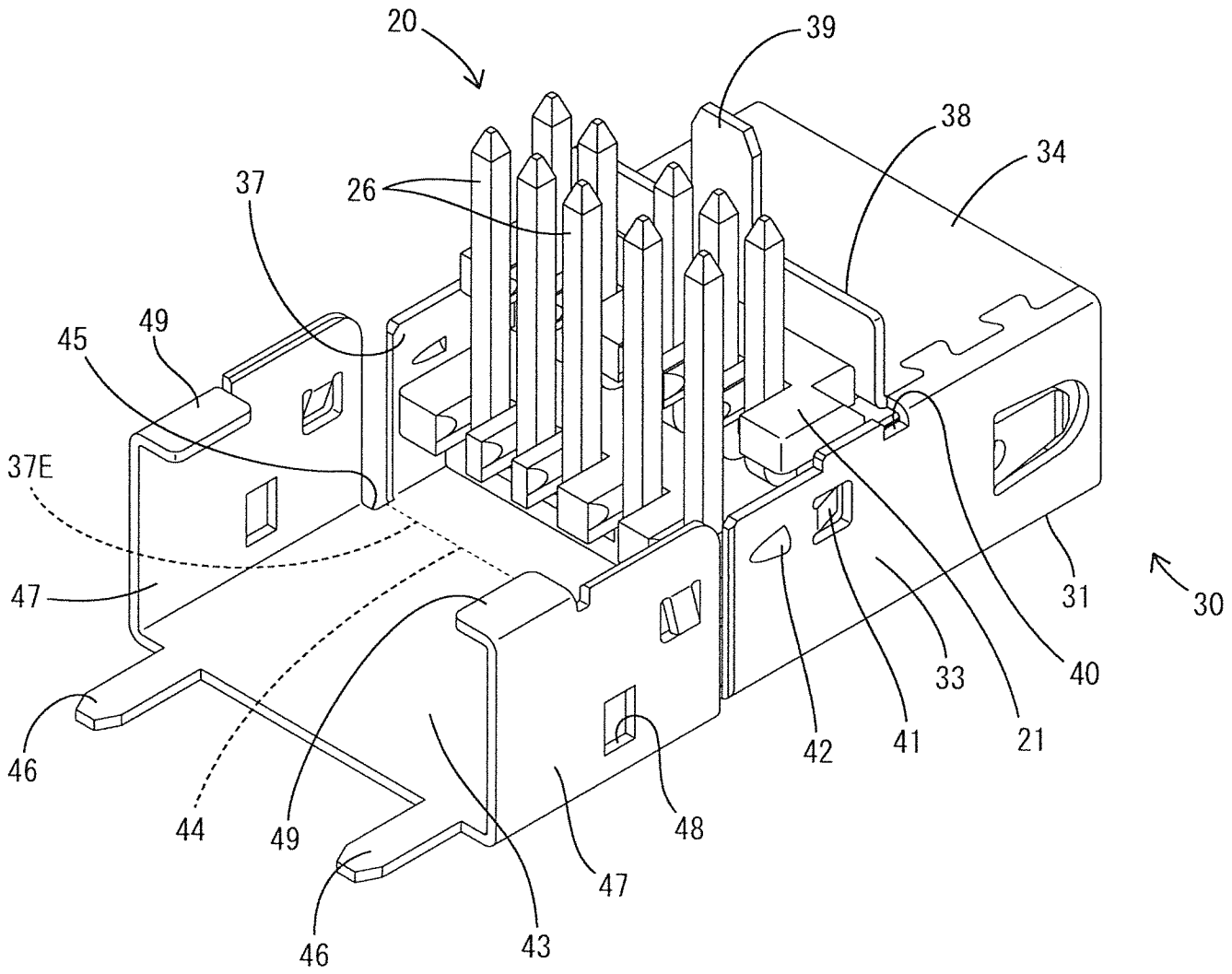
FIG. 5 is a vertically inverted perspective view showing a state in which the dielectric module is inserted into a module housing portion.
Figure 6:
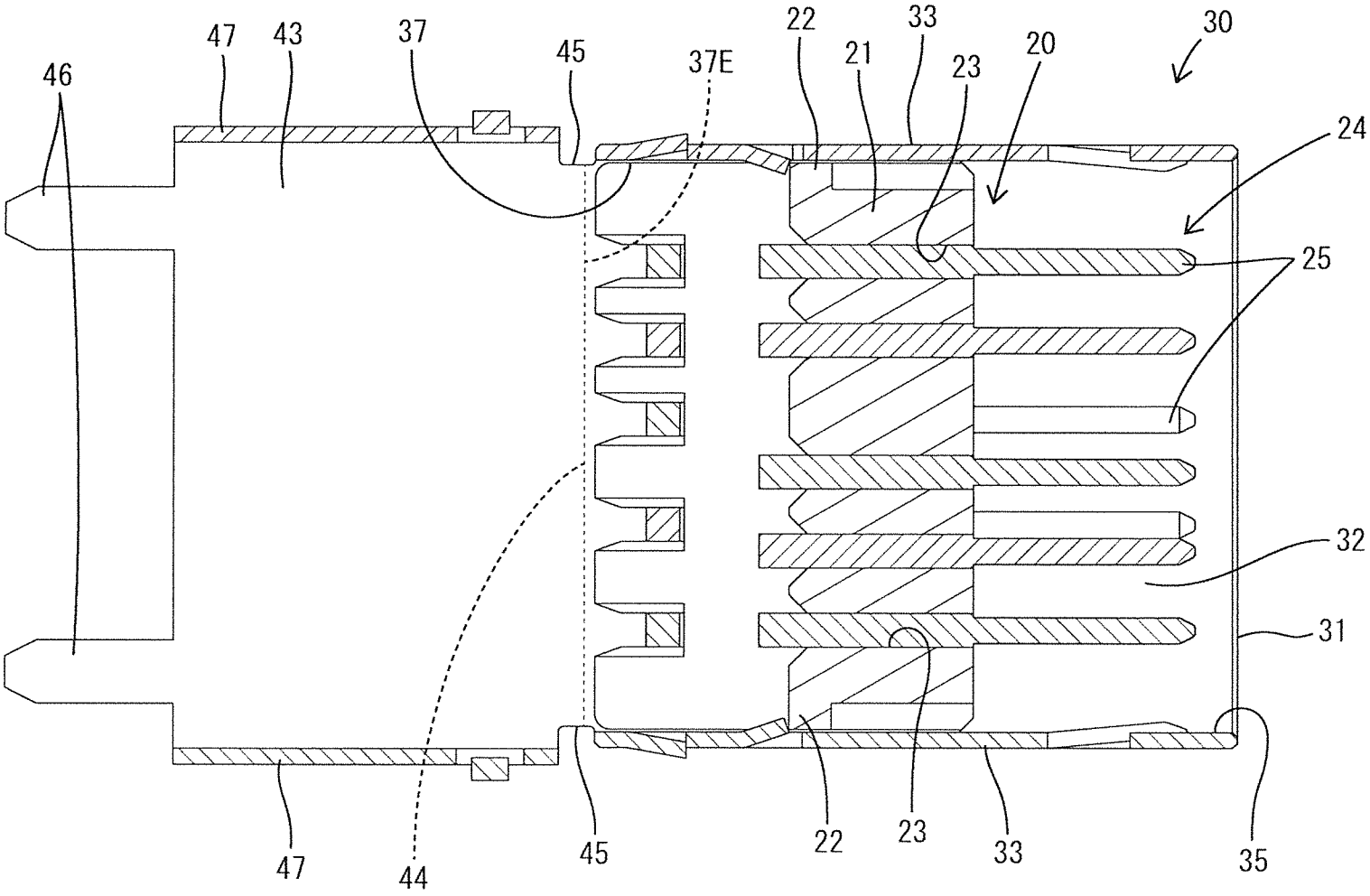
FIG. 6 is a bottom cross-sectional view showing a state in which the dielectric module is inserted into the module housing portion.
Figure 7:
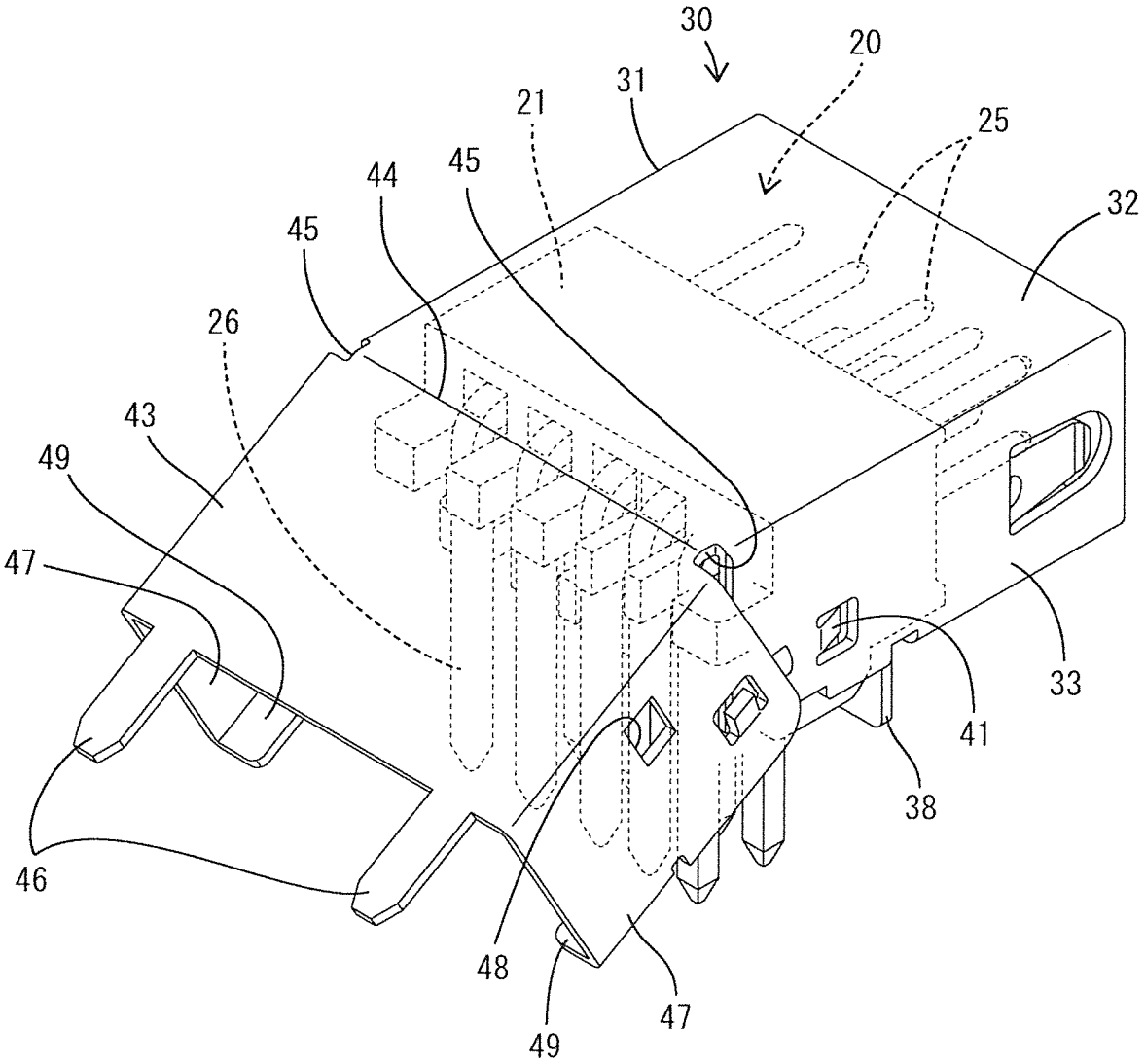
FIG. 7 is a perspective view showing a state in which a lid portion is being displaced from an open position to a closed position after the dielectric module is inserted into the module housing portion.
Figure 8:
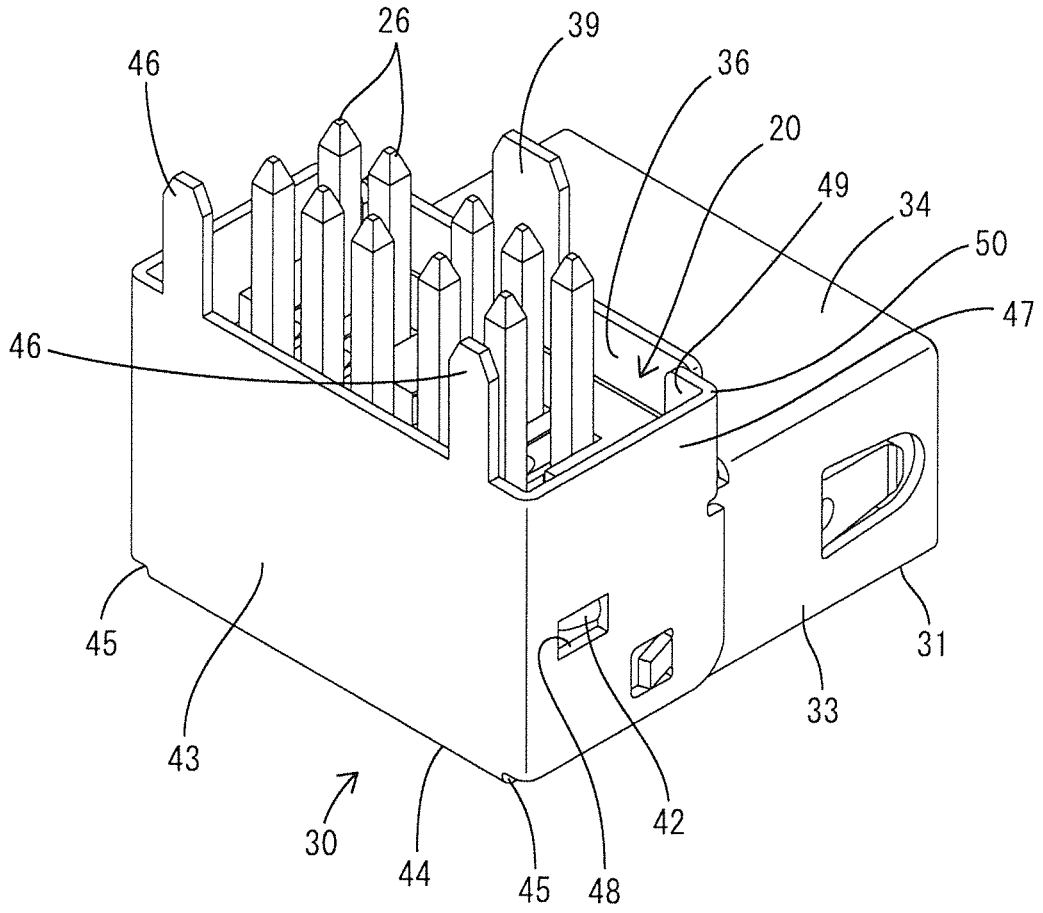
FIG. 8 is a vertically inverted perspective view showing a state in which the lid portion has been displaced to the closed position.
Figure 9:
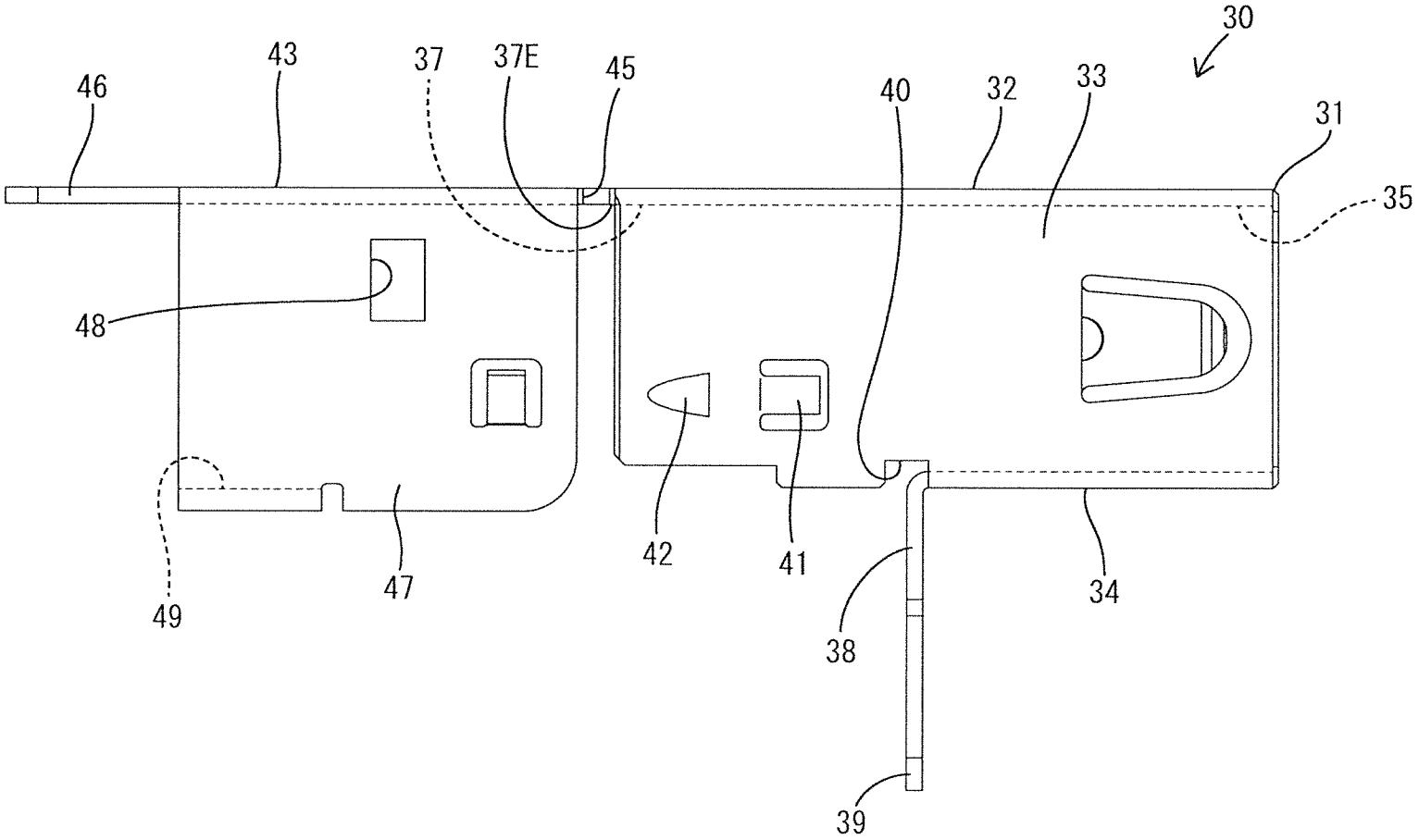
FIG. 9 is a side view of the outer conductor.
Figure 10:
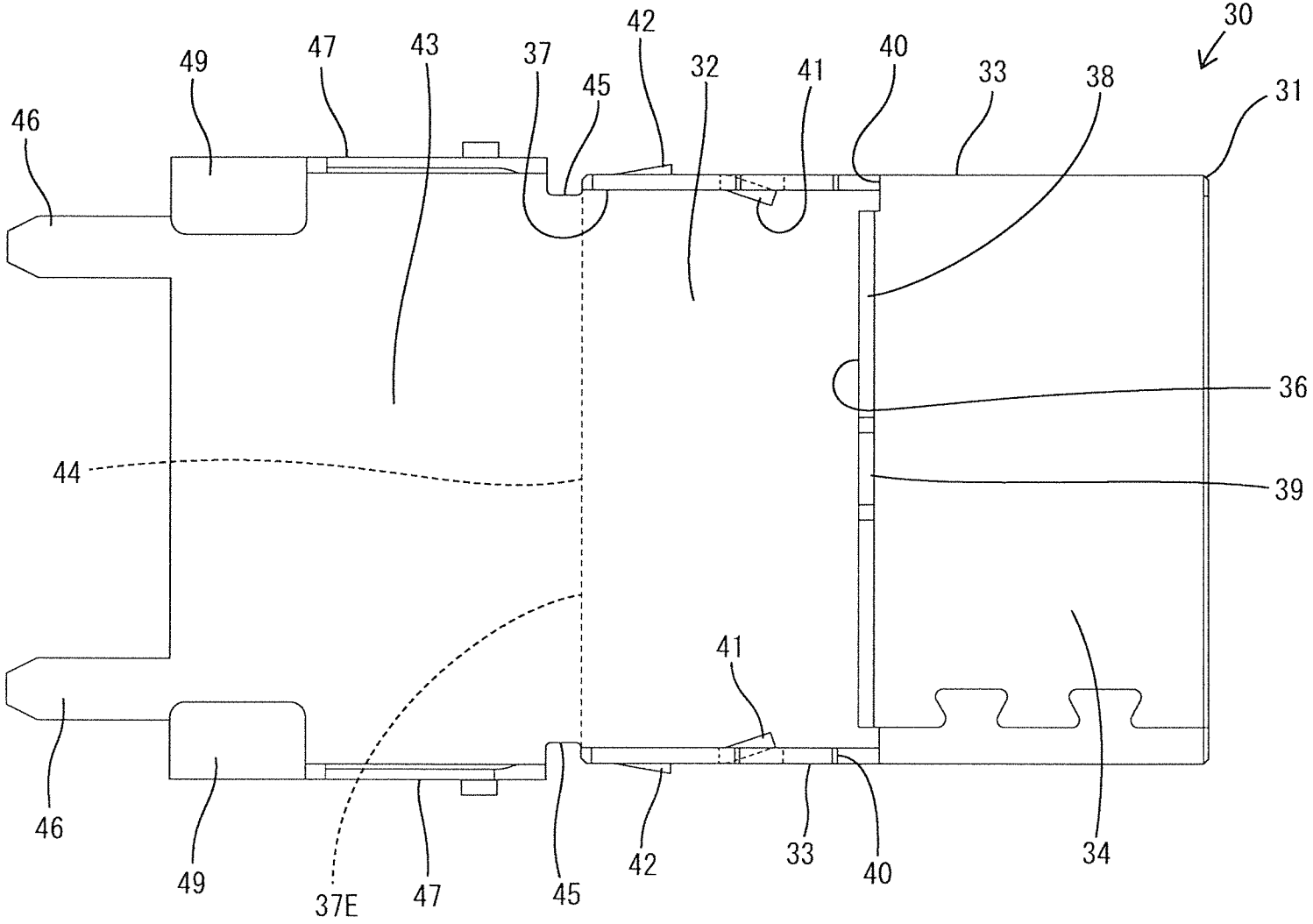
FIG. 10 is a bottom view of the outer conductor.
Figure 11:
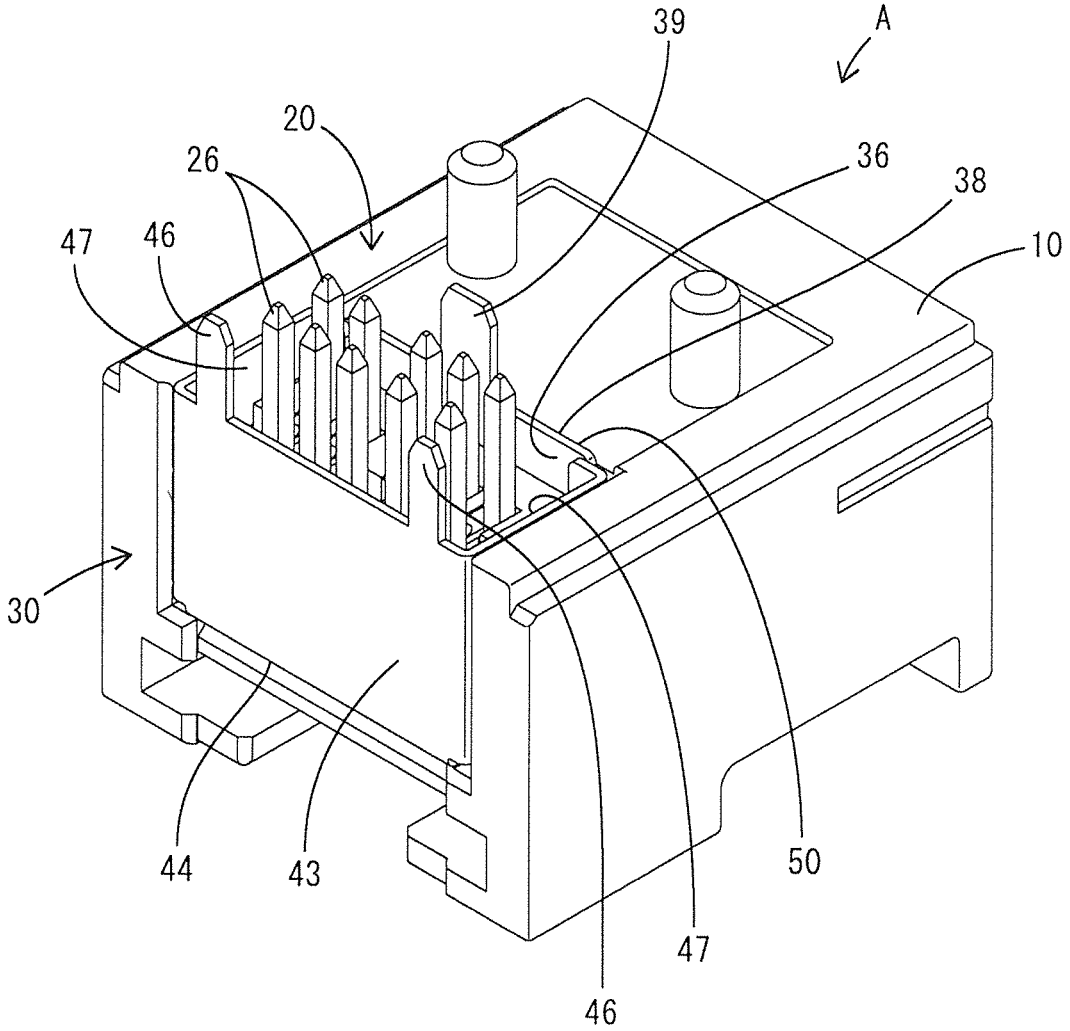
FIG. 11 is a vertically inverted perspective view showing a vertically inverted state of the shielded connector.

Hereinafter, Embodiment 1 in which the present invention is embodied will be described with reference to FIGS. 1 to 11. In the following description, as for the front-rear direction, the diagonally lower left side in FIG. 1, the diagonally upper right side in FIGS. 2 to 5, 7, 8, and 11, and the right side in FIGS. 6, 9, and 10 are defined as the front sides. For an up-down direction, the directions shown in FIGS. 1 to 3, 7, and 9 are defined as upward and downward as they are. In FIGS. 4, 5, 8, and 11, vertically inverted directions are shown.

A shielded connector A of Embodiment 1 is to be attached to an upper surface of a horizontally installed circuit board (not shown). The shielded connector A is constructed by assembling a housing 10 made of synthetic resin, a dielectric module 20, and an outer conductor 30. In the housing 10, the front end surface, the rear end surface, and the lower surface rear end portion are opened to the outside. Inside the housing 10, the dielectric module 20 and the outer conductor 30 are housed.

<Dielectric Module 20>

The dielectric module 20 is constructed by assembling a dielectric 21 made of synthetic resin and a plurality of elongated terminal fittings 24 bent in a substantially L shape in a side view. The dielectric 21 has a block shape, and stepped locking portions 22 facing rearward are formed on both right and left side surfaces of the dielectric 21. Inside the dielectric 21, a plurality of attachment holes 23 each penetrating in the front-rear direction is formed.

The terminal fitting 24 has a first connecting portion 25 extending horizontally to be connected to a female terminal fitting (not shown) of a wire harness and a second connecting portion 26 extending downward from a rear end portion of the first connecting portion 25. The second connecting portion 26 is connected to the circuit board. The first connecting portion 25 is inserted from the rear side of the dielectric 21 into the attachment hole 23, whereby the terminal fitting 24 is attached to the dielectric 21. In the state in which the terminal fitting 24 is attached to the dielectric 21, the first connecting portion 25 protrudes forward from a front end surface of the dielectric 21, and the second connecting portion 26 protrudes downward from a lower surface of the dielectric 21.

<Outer Conductor 30>

The outer conductor 30 is formed into a predetermined shape obtained by applying bending processing or the like to a conductive metal plate material. The outer conductor 30 is a single component having a box-shaped module housing portion 31, a single flat plate-shaped lid portion 43 continuous with a rear end portion of the module housing portion 31, and a pair of laterally symmetrical outer plate portions 47 continuous with the lid portion 43.

The module housing portion 31 has an upper plate portion 32 having a rectangular shape in plan view, a pair of side plate portions 33 having a rectangular shape extending downward substantially at a right angle from right and left side edges of the upper plate portion 32, and a lower plate portion 34 extending substantially at a right angle from a lower end edge of one of the side plate portions 33 and locked to a lower end edge of the other side plate portion 33, so that the module housing portion 31 has a rectangular cylindrical shape as a whole. A front end surface of the module housing portion 31 is opened forward (outside of the module housing portion 31) as a first opening 35 over the entire region thereof. A shield shell (not shown) of the wire harness is fitted and connected to the first opening 35.

A rear end side region in a lower surface of the module housing portion 31 is opened downward (outside of the module housing portion 31) as a second opening 36. The second opening 36 is disposed so as to face a surface (mounting surface) of the circuit board when the shielded connector A is attached to the circuit board. The entire region of a rear end surface of the module housing portion 31 is opened as an insertion port 37. Inside and outside of the module housing 31 are communicated with each other through the insertion port 37, and the insertion port 37 communicates with the second opening 36 over the entire width.

In order to form the second opening 36, a rear end of the lower plate portion 34 is locate forward relative to the rear end of the upper plate portion 32 and the rear ends of the side plate portion 33. The lower plate portion 34 is formed with a projecting plate portion 38 extending downward from a rear end edge of the lower plate portion 34 over the entire width at a substantially right angle. The projecting plate portion 38 is disposed along a front end edge of the second opening 36. The projecting plate portion 38 is formed with a first earthing leg portion 39 which extends downward from a widthwise central position of a lower end edge of the projecting plate portion 38 in a flush manner. The first earthing leg portion 39 is disposed at a front edge portion of an opening edge of the second opening 36. The lower end edges of the right and left side plate portions 33 have a pair of symmetrical right and left locking recesses 40 each formed at a position adjacent to the rear side of the projecting plate portion 38.

The right and left side plate portions 33 have a pair of symmetrical right and left holding portions 41 each formed at a rearward and upward position relative to the locking recess 40. The holding portion 41 has a form such that a part of the side plate portion 33 is cut and raised diagonally in a cantilever manner to the inside of the module housing portion 31 to be elastically deformable. A free end of the holding portion 41 faces forward. The right and left side plate portions 33 have a pair of symmetrical right and left protrusions 42 each formed at a rearward position relative to the holding portion 41. The protrusion 42 has a form such that a part of the side plate portion 33 is knocked out to the outside of the module housing portion 31.

The lid portion 43 is continuous with a rear end edge of the upper plate portion 32, that is, an upper edge portion 37E in an opening edge of the insertion port 37 (the opening edge of the insertion port described in the claims) over the entire width thereof. In a state before the dielectric module 20 is inserted into the module housing portion 31, the lid portion 43 extends rearward from the rear end edge of the upper plate portion 32 so as to be flush with the upper plate portion 32. The position of the lid portion 43 at this time is defined as an open position (see FIGS. 1, 4 to 6, 9, and 10). In a state in which the lid portion 43 is at the open position, the insertion port 37 is opened rearward.

The upper edge portion 37E (the rear end edge of the upper plate portion 32) of the insertion port 37 is a boundary line 44 in a width direction (lateral direction) dividing the module housing portion 31 and the lid portion 43. With the boundary line 44 as a fold, the lid portion 43 can be displaced at an angle of about 90° from the open position to a closed position where the entire region of the insertion port 37 is closed (see FIGS. 8 and 11). In a state in which the lid portion 43 has been displaced to the closed position, the second opening 36 is not closed, and a lower end edge portion of the lid portion 43 constitutes a rear edge portion of the opening edge of the second opening 36.

Both right and left end portions of the boundary line 44 are formed with a pair of symmetrical right and left cutout portions 45. Since the cutout portions 45 are formed, the width dimension (the dimension in the lateral direction) of the boundary line 44 is smaller than the width dimension of the upper plate portion 32 and the width dimension of the lid portion 43. Since the boundary line 44 is shortened, when the lid portion 43 is bent from the open position to the closed position, the position of the fold is rendered stable.

Both right and left end portions of the lid portion 43 are formed with a pair of symmetrical right and left second earthing leg portions 46. In the state in which the lid portion 43 is at the open position, the paired second earthing leg portions 46 extend rearward from a rear end edge of the lid portion 43 in a flush manner. In a state in which the lid portion 43 has been displaced to the closed position, the paired second earthing leg portions 46 is disposed at the rear edge portion of the opening edge of the second opening 36 and protrudes downward similarly to the first earthing leg portion 39.

The paired outer plate portions 47 are continuous with the right and left side edges of the lid portion 43 respectively at a substantially right angle. In a state in which the lid portion 43 is at the open position, the paired outer plate portions 47 extend downward from the lid portion 43 so as to face each other substantially in parallel. In a state in which the lid portion 43 has been displaced to the closed position, each of the outer plate portions 47 extends forward from the lid portion 43 and is disposed so as to overlap outer surface of a rear end side region of the side plate portion 33. In the state in which the lid portion 43 has been displaced to the closed position, vertically elongated gaps between rear edge portions of the side plate portions 33 and the right and left side edge portions of the lid portion 43 are closed by rear edge portions of the respective outer plate portions 47.

The right and left outer plate portions 47 are formed with a pair of symmetrical right and left window holes 48. In the state in which the lid portion 43 has been displaced to the closed position, each of the window holes 48 is located so as to correspond to the protrusion 42 of the module housing portion 31. As a result, the protrusion 42 is exposed to the outside through the window hole 48. In a state in which the lid portion 43 is located between the closed position and the open position, the projections 42 are covered and hidden by the outer plate portions 47. In a state in which the lid portion 43 is at the closed position, the holding portions 41 are covered and hidden by the outer plate portions 47 from the outer surface side.

The paired outer plate portions 47 are formed with a pair of symmetrical right and left plate-shaped locking portions 49 protruding from the respective outer edge portions of the outer plate portion 47 on the side opposite to the lid portion 43. The paired locking portions 49 each makes a substantially right angle with the outer plate portion 47 and extends inward from the outer plate portion 47 so as to be parallel to the lid portion 43. In the state in which the lid portion 43 is at the open position, the paired locking portions 49 are each located at a rear end portion of the outer plate portion 47, and in the state in which the lid portion 43 is at the closed position, the paired locking portions 49 are each located at a lower end portion of the outer plate portion 47.

In the state in which the lid portion 43 has been displaced to the closed position, the paired locking portions 49 are locked to the paired locking recesses 40 of the module housing portion 31. Due to the locking between the locking portions 49 and the locking recesses 40, the lid portion 43 is held at the closed position while being restricted from displacement to the open position. In addition, due to locking between the protrusions 42 and the window holes 48, the lid portion 43 is also held at the closed position while being restricted from displacement to the open position. In the state in which the lid portion 43 is at the closed position, a lower end portion of the lid portion 43, the lower end portions of the right and left outer plate portions 47, and the projecting plate portion 38 constitute a peripheral wall portion 50 which protrudes downward relative to the lower plate portion 34 of the module housing portion 31. The peripheral wall portion 50 is disposed so as to be along the entire periphery of the opening edge of the second opening 36.

<Operation and Effect of Embodiment 1>

When the shielded connector A is to be assembled, the dielectric module 20 is inserted into the insertion port 37 from the rear side and housed in the module housing part 31 in the state in which the lid portion 43 is at the open position. The locking portions 22 of the dielectric 21 are locked to the holding portions 41 of the module housing portion 31, whereby the inserted dielectric module 20 is held in a state of being housed in the module housing portion 31.

Thereafter, the lid portion 43 is bent with the boundary line 44 as a fulcrum (fold) to be displaced from the open position to the closed position, and held at the closed position by locking between the locking portions 49 and the locking recesses 40. By the displacement of the lid portion 43 to the closed position, the assembly of the outer conductor 30 and the assembly between the outer conductor 30 and the dielectric module 20 are completed. The outer conductor 30 and the dielectric module 20 assembled together are housed in the housing 10, whereby the assembly of the shielded connector A is completed.

In a state in which the dielectric module 20 is surrounded by the outer conductor 30, front end side regions of the respective first connecting portions 25 projecting forward from the dielectric 21 are collectively surrounded by a front end portion of the module housing portion 31. In addition, upper side regions of the respective second connecting portions 26 protruding downward from the dielectric 21 are collectively surrounded by the peripheral wall portion 50. In the second connecting portion 26, lower end portions of the respective second connecting portions 26 protruding downward below the peripheral wall portion 50 are inserted into through-holes (not shown) of the circuit board to be connected conductively. The first earthing leg portion 39 and the second earthing leg portion 46 are inserted into earthing through-holes (not shown) of the circuit board to be connected conductively.

As described above, the shielded connector A of Embodiment 1 includes the dielectric module 20 having the L-shaped terminal fitting 24 attached to the dielectric 21 and the outer conductor 30 which houses the dielectric module 20. The outer conductor 30 is a single component in which the box-shaped module housing portion 31 and the plate-shaped lid portion 43 are integrated. The front end surface of the module housing portion 31 is opened as the first opening 35. The rear end side region of the lower surface of the module housing portion 31 is opened as the second opening 36. The rear end surface of the module housing portion 31 is opened as the insertion port 37 communicating with the second opening 36.

The lid portion 43 is continuous with the upper edge portion 37E of the opening edge of the insertion port 37 and is configured to be displaced from the open position to the closed position thereby constituting the outer conductor 30. In the state in which the lid portion 43 is at the open position, the insertion port 37 is opened, and the dielectric module 20 is allowed to be inserted into the module housing portion 31 through the insertion port 37. In the state in which the lid portion 43 is at the closed position, the insertion port 37 is closed.

According to the shielded connector A, in the state in which the lid portion 43 is at the open position, the dielectric module 20 can be inserted into the module housing portion 31 through the insertion port 37. After the dielectric module 20 is inserted into the module housing portion 31, the lid portion 43 is displaced from the open position to the closed position, whereby the insertion port 37 is closed. As a result, the outer conductor 30 can exhibit a stable and high-performance shielding function. Since the outer conductor 30 of Embodiment 1 is a single component in which the module housing portion 31 and the lid portion 43 are integrated, the number of components can be reduced.

The outer conductor 30 includes the paired right and left outer plate portions 47 which are continuous with the lid portion 43 and overlaps the outer surfaces of the module housing portion 31 in the state in which the lid portion 43 has been displaced to the closed position. According to this configuration, the shielding function is improved in the regions of the module housing portion 31 where the outer plate portions 47 overlap (the rear end side regions of the side plate portions 33).

Furthermore, the region of the module housing portion 31 where the outer plate portion 47 overlaps is provided with the holding portion 41 to which the dielectric 21 is locked whereby the dielectric module 20 is held in the module housing portion 31. According to this configuration, the holding portion 41 can prevent the dielectric 21 from being separated due to interference of foreign matter, so that the dielectric module 20 can be reliably housed in the module housing portion 31.

The protrusion 42 is formed on the outer surface of the module housing portion 31, and the outer plate portion 47 is formed with the window hole 48 which causes the protrusion 42 to be exposed therethrough only when the lid portion 43 is at the closed position. According to this configuration, it is possible to detect whether or not the lid portion 43 is correctly displaced to the closed position based on whether or not the protrusion 42 is exposed through the window hole 48.

The paired cutout portions 45 are formed at both ends of the boundary line 44 dividing the module housing portion 31 and the lid portion 43. According to this configuration, the boundary line 44 can serve as a hinge easy to bend due to the paired cutout portions 45, so that processing accuracy is improved when the lid portion 43 is displaced from the open position to the closed position.

Embodiment 2

Figure 12:
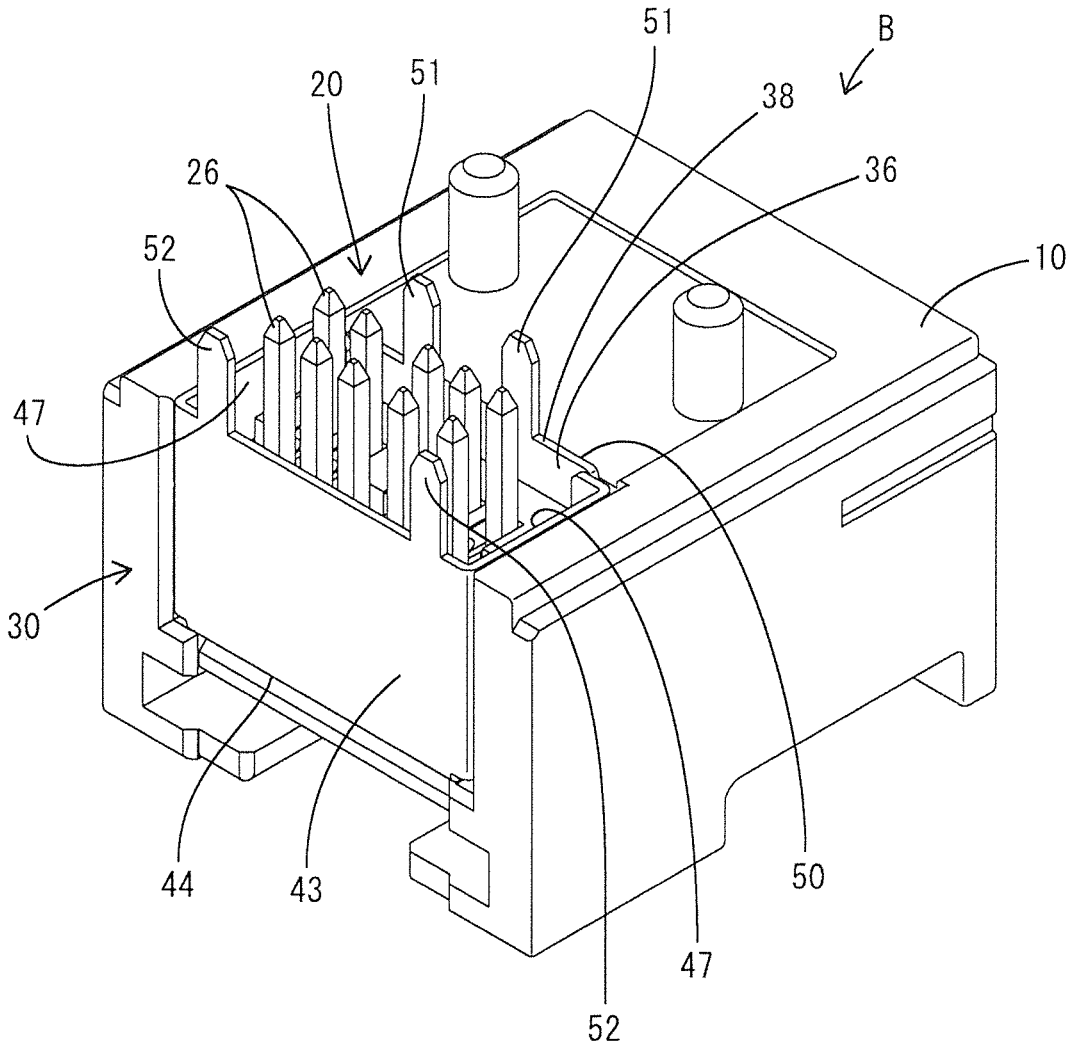
FIG. 12 is a vertically inverted perspective view showing a vertically inverted state of a shielded connector of Embodiment 2.

Next, Embodiment 2 in which the present invention is embodied will be described with reference to FIG. 12. In a shielded connector B of Embodiment 2, the projecting plate portion 38 is formed with a pair of right and left first earthing leg portions 51, and the lid portion 43 is formed with a pair of right and left second earthing leg portions 52. Since other configurations are the same as those of Embodiment 1, the same components are labeled by the same symbols as those of Embodiment 1, and explanation of the structure, operation, and effect thereof is omitted.

Embodiment 3

Figure 13:
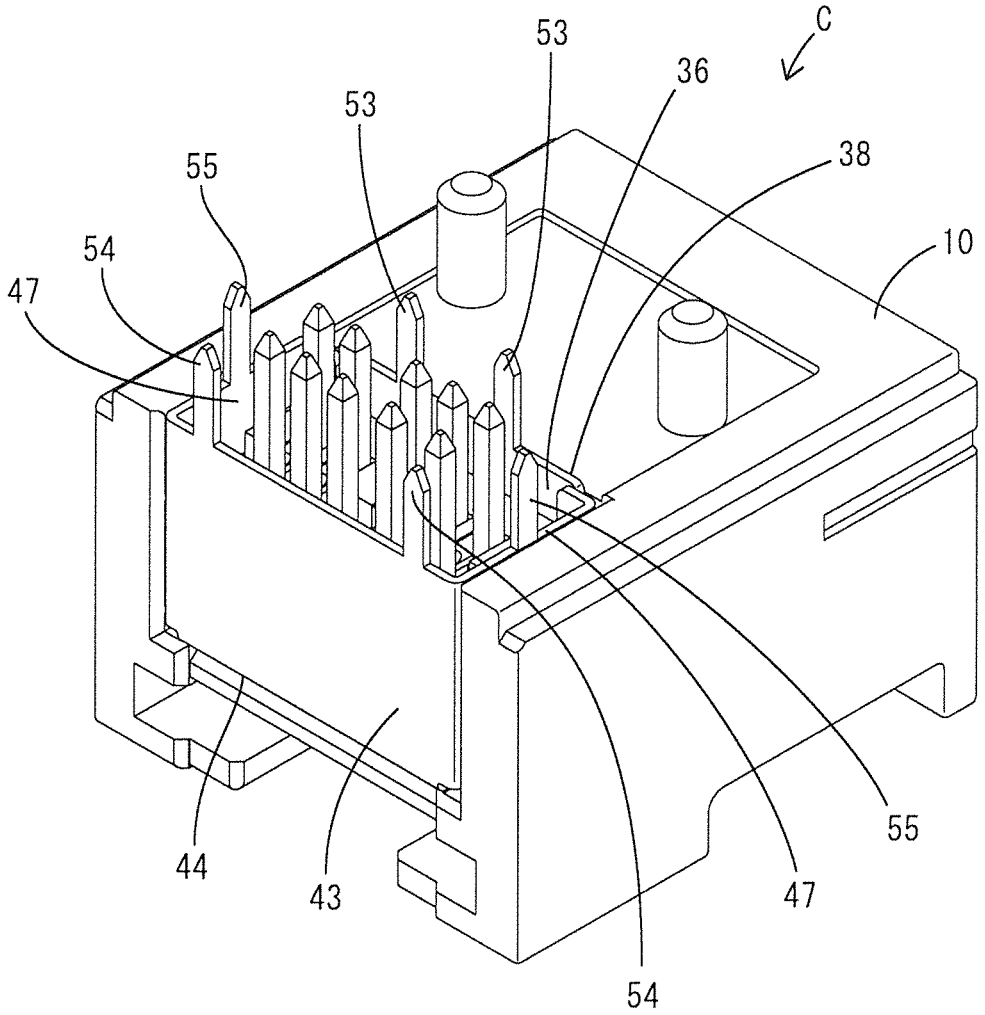
FIG. 13 is a vertically inverted perspective view showing a vertically inverted state of a shielded connector of Embodiment 3.

Next, Embodiment 3 in which the present invention is embodied will be described with reference to FIG. 13. In a shielded connector C of Embodiment 3, the projecting plate portion 38 is formed with a pair of right and left first earthing leg portions 53, the lid portion 43 is formed with a pair of right and left second earthing leg portions 54, and furthermore, the right and left outer plate portions 47 are each formed with a third earthing leg portion 55 which is parallel to the first earthing leg portions 53 and the second earthing leg portions 54. Since other configurations are the same as those of Embodiment 1, the same components are labeled by the same symbols as those of Embodiment 1, and explanation of the structure, operation, and effect thereof is omitted.

Other Embodiments

The present invention is not limited to the above embodiments, which have been described using the foregoing description and the drawings, and, for example, embodiments as described below are also encompassed within the technical scope of the present invention.

(1) Although the lid portion 43 is continuous with the upper edge portion 37E of the insertion port 37 in Embodiments 1 to 3, the lid portion may be continuous with one of the right and left side edges of the insertion port.

(2) Although only one lid portion 43 is provided in Embodiments 1 to 3, a plurality of lid portions may be provided. In this case, two lid portions may be provided to be continuous with two edges among the upper end edge and right and left side edges of the insertion port, respectively, or three lid portions may be provided to be continuous with the upper end edge and right and left side edges of the insertion port, respectively.

(3) Although the holding portion 41 locked to the dielectric 21 is covered with the outer plate portion 47 in Embodiments 1 to 3, the holding portion may be not covered with the outer plate portion but be exposed to the outside.

(4) In Embodiments 1 to 3, the lid portion 43 is continuous with the upper plate portion 32 of the module housing portion 31 (the upper edge portion 37E of the insertion port 37), and the paired outer plate portions 47 overlap the outer surfaces of the right and left side plate portions 33 of the module housing portion 31. However, in the case where the lid portion is continuous with one of the right and left side plate portions of the module housing portion (the left or right side edge of the insertion port), the outer plate portion may overlap the upper plate portion of the module housing portion or may overlap the side plate portion opposite to the side plate portion with which the outer plate portion of the module housing portion are continuous.

(5) Although the outer plate portions 47 are continuous with the lid portion 43 in Embodiments 1 to 3, the outer conductor may not have the outer plate portion.

(6) Although the paired cutout portions 45 are formed at both ends of the boundary line 44 between the module housing portion 31 and the lid portion 43 in Embodiments 1 to 3, the boundary line may not be formed with cutout portions.

(7) Although the shielded connector to be attached to a circuit board has been described in Embodiments 1 to 3, the present invention can also be applied to a shielded connector not attached to a circuit board.

REFERENCE SIGNS LIST

A, B, C shielded connector
20 dielectric module
21 dielectric
24 terminal fitting
30 outer conductor
31 module housing portion
35 first opening
36 second opening
37 insertion port
37E upper edge portion (opening edge of insertion port)
41 holding portion
42 protrusion
43 lid portion
44 boundary line
45 cutout portion
47 outer plate portion
48 window hole

The invention claimed is:

1. A shielded connector comprising:

a dielectric module having an L-shaped terminal fitting attached to a dielectric; and an outer conductor that houses the dielectric module, wherein the outer conductor is a single component comprising:

a box-shaped module housing portion having a front end surface opened as a first opening, a rear end side region of a lower surface opened as a second opening, and a rear end surface opened as an insertion port communicating with the second opening;

a plate-shaped lid portion that is continuous with an opening edge of the insertion port and is displaceable from an open position where the insertion port is opened to allow the dielectric module to be inserted into the module housing portion to a closed position where the insertion port is closed; and an outer plate portion that is continuous with the lid portion and overlaps an outer surface of the module housing portion in a state in which the lid portion has been displaced to the closed position, wherein:

a region of the module housing portion where the outer plate portion overlaps is provided with a holding portion to which the dielectric is locked whereby the dielectric module is held in the module housing portion, in a state in which the lid portion has been displaced to the closed position, the holding portion is covered and hidden by the outer plate portion from an outer surface side, a first earthing leg portion protrudes from a front end edge of the second opening, in the state in which the lid portion has been displaced to the second closed position, a second earthing leg portion protrudes from a rear end edge of the second opening, and the first earthing leg portion and the second earthing leg portion are arranged so as to sandwich the terminal fitting from front and back in the second opening.

2. The shielded connector according to claim 1, further comprising:

a protrusion formed on the outer surface of the module housing portion; and a window hole that is formed in the outer plate portion and causes the protrusion to be exposed therethrough only when the lid portion is at the closed position.

3. The shielded connector according to claim 2, wherein both ends of a boundary line dividing the module housing portion and the lid portion are formed with a pair of cutout portions.

4. The shielded connector according to claim 1, wherein both ends of a boundary line dividing the module housing portion and the lid portion are formed with a pair of cutout portions.

* * * * *